US009319796B2

(12) United States Patent
Takada

(10) Patent No.: US 9,319,796 B2
(45) Date of Patent: Apr. 19, 2016

(54) VOICE COIL SPEAKER

(71) Applicant: CLARION CO., LTD., Saitama (JP)
(72) Inventor: Naoki Takada, Saitama (JP)
(73) Assignee: CLARION CO., LTD., Saitama-Shi, Saitama (JP)

( * ) Notice: Subject to any disclaimer, the term of this patent is extended or adjusted under 35 U.S.C. 154(b) by 0 days.

(21) Appl. No.: 14/423,583
(22) PCT Filed: Jul. 30, 2013
(86) PCT No.: PCT/JP2013/070557
§ 371 (c)(1),
(2) Date: Feb. 24, 2015
(87) PCT Pub. No.: WO2014/034352
PCT Pub. Date: Mar. 6, 2014
(65) Prior Publication Data
US 2015/0326975 A1 Nov. 12, 2015
(30) Foreign Application Priority Data
Aug. 29, 2012 (JP) ..... 2012-188890
(51) Int. Cl.
*H04R 9/06* (2006.01)
*H04R 9/04* (2006.01)
(Continued)
(52) U.S. Cl.
CPC ..... *H04R 9/046* (2013.01); *H04R 3/00* (2013.01); *H04R 9/02* (2013.01); *H04R 9/04* (2013.01); *H04R 9/06* (2013.01); *H04R 2209/022* (2013.01); *H04R 2499/13* (2013.01)
(58) Field of Classification Search
CPC ..... H04R 1/06; H04R 9/04; H04R 9/045; H04R 9/046; H04R 9/06; H04R 2209/022; H04R 2209/041; H04R 2499/13; H04R 3/00; H04R 3/14; H04R 9/02
USPC ..... 381/120, 164, 189, 386, 396, 397, 400, 381/401, 402, 403, 404, 407, 409, 410
See application file for complete search history.

(56) References Cited

U.S. PATENT DOCUMENTS 5,778,086 A * 7/1998 Tanabe ..... H01R 9/16 381/386
6,587,571 B1 * 7/2003 Fujihira ..... H04R 9/046 381/401

(Continued)

FOREIGN PATENT DOCUMENTS

JP 62-150999 A 7/1987
JP 10-051895 A 2/1998

(Continued)

OTHER PUBLICATIONS

International Search Report dated Oct. 1, 2013 issued in corresponding PCT/JP2013/070557 application (pp. 1-2).

(Continued)

*Primary Examiner* — Huyen D Le

(57) ABSTRACT

A voice speaker in which a signal line is properly designed to suppress deterioration of sound quality is provided.
A voice coil speaker 1 has a diaphragm 24 and a bobbin 21*a* which is connected to the diaphragm 24 and has a voice coil 22 formed thereon. The bobbin 21*a* has a bobbin main portion 65 having the voice coil 22 wound therearound, and an extension portion 67 which extends from the bobbin main portion 65 and in which a signal line conducted to the voice coil 22 is formed. The bobbin main portion 65 and the extension portion 67 are integrally formed of a flexible print board, and a site at which the extension portion 67 extends is covered by a shield case 34.

6 Claims, 10 Drawing Sheets

1

(51) Int. Cl.
*H04R 3/00* (2006.01)
*H04R 9/02* (2006.01)

(56) References Cited

U.S. PATENT DOCUMENTS

| | | | |
|---|---|---|---|
| 2010/0239101 | A1 | 9/2010 | Okamura et al. |
| 2013/0022219 | A1 | 1/2013 | Takada et al. |

FOREIGN PATENT DOCUMENTS

| | | | |
|---|---|---|---|
| JP | 2010-028785 | A | 2/2010 |
| JP | 2011-223289 | A | 11/2011 |
| JP | 2012-015873 | A | 1/2012 |

OTHER PUBLICATIONS

English Abstract and Machine Translation for JP2012-015873, Publication Date: Jan. 19, 2012.
English Abstract and Machine Translation for JP2010-028785, Publication Date: Feb. 4, 2010.
English Abstract and Machine Translation for JP10-051895, Publication Date: Feb. 20, 1998.
Partial English Translation for JP62-150999, Publication Date: Jul. 4, 1987.
English Abstract and Machine Translation for JP2011-223289, Publication Date: Nov. 4, 2011.
International Preliminary Report on Patentability issued in corresponding PCT/JP2013/070557 application.

* cited by examiner (B)

(A)

VOICE COIL SPEAKER

TECHNICAL FIELD

The present invention relates to a voice coil speaker having a voice coil formed around a bobbin.

BACKGROUND ART

A voice coil speaker in which a bobbin having a voice coil formed thereon is connected to a diaphragm is known (see Patent Document 1, for example). In this type of voice coil speaker, a circuit board for processing audio signals is connected to the voice coil through a signal line for outputting a driving signal.

PRIOR ART DOCUMENT

Patent Document

Patent Document 1: JP-A-2010-28785

SUMMARY OF THE INVENTION

Problem to be Solved by the Invention

In a voice coil speaker in which a driving signal is output to a voice coil through a signal line as in the case of the voice coil speaker described above, it is necessary to suppress adverse effect of existence of the signal line on the operation of the voice coil, thereby preventing deterioration of sound quality.

The present invention has been implemented in view of the foregoing situation, and has an object to provide a voice coil speaker for which a signal line is properly designed and deterioration of sound quality is suppressed.

Means of Solving the Problem

In order to attain the above object, according to the present invention, a voice coil speaker comprises a diaphragm, and a bobbin that is connected to the diaphragm and has a voice coil formed thereon, wherein the bobbin has a bobbin main portion around which the voice coil is wound, and an extension portion that extends from the bobbin main portion and in which a signal line conducted to the voice coil is formed, the bobbin main portion and the extension portion are integrally formed of a flexible print board, and a site at which the extension portion extends is covered by a shield case.

In the present invention, the shield case is equipped at a back side of a yoke, a cut-out portion is formed in the yoke, and the extension portion is configured to pass through the cut-out portion and extend into the shield case at the back side of the yoke.

In the present invention, the yoke has a yoke bottom portion and a yoke protrusion portion protruding from the yoke bottom portion into the bobbin, a side surface cut-out portion is formed at a site corresponding to the extension portion on a side surface of the yoke protrusion portion, a bottom surface cut-out portion intercommunicating with the side surface cut-out portion is formed in the yoke bottom portion, and the extension portion extending from the bobbin main portion is configured to pass through the side surface cut-out portion and the bottom surface cut-out portion and extend into the shield case at the back side of the yoke.

In the present invention, the side surface cut-out portion is formed at a site on the side surface of the yoke protrusion portion where the side surface cut-out portion avoids to face the voice coil.

In the present invention, a circuit board for processing audio signals is disposed in the shield case equipped at the backside of the yoke, and a tip of the extension portion is connected to the circuit board.

In the present invention, a digital driver circuit is mounted on the circuit board.

In the present invention, a plurality of extension portions are equipped, and the plurality of extension portions are located to be symmetrical with one another with respect to a center axis of the bobbin.

In the present invention, the plurality of extension portions are equipped at equal intervals in a peripheral direction of the bobbin.

According to the present invention, in the voice speaker, no shield member is attached to a site of the extension portion that is covered by the shield case.

Effect of the Invention

According to the present invention, the site at which the extension portion extends is coved by the shield case, and thus noise to signals flowing in the signal line formed in the extension portion can be prevented, so that the sound quality can be enhanced.

MODES FOR CARRYING OUT THE INVENTION

Embodiments according to the present invention will be described hereunder with reference to the drawings.

First Embodiment

Figure 1:
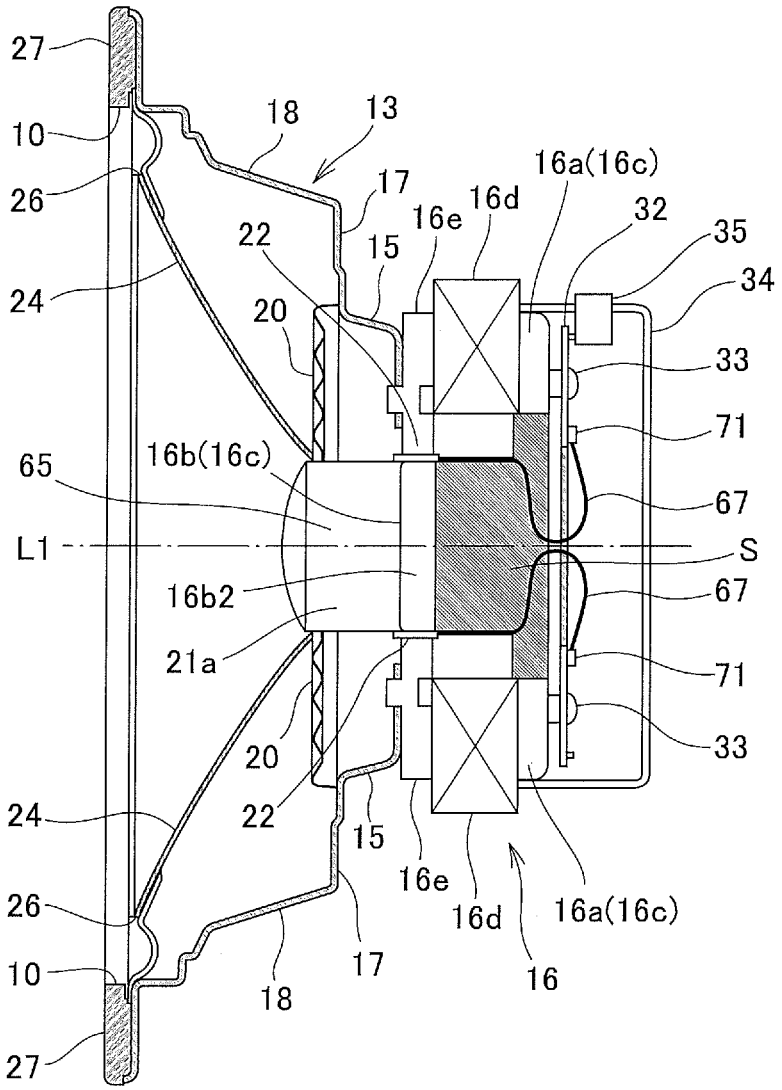
FIG. 1 is a cross-sectional view showing a voice coil speaker according to a first embodiment of the present invention.

FIG. 1 is a cross-sectional view showing a voice coil speaker 1 according to a first embodiment. In FIG. 1, the center axis of the voice coil speaker 1 is represented by reference numeral L1.

The voice coil speaker 1 according to this embodiment is a speaker which is secured, for example, to the side surface of a door of a vehicle, supplied with a digital audio signal from an in-vehicle audio device and outputs sounds on the basis of the digital audio signal.

As shown in FIG. 1, the voice coil speaker 1 has a cylindrical speaker frame 13 which has a bottom and a circular speaker opening 10 at the front surface thereof.

A bowl-shaped frame rear portion 15 which is configured to increase in diameter towards the front side and has a circular opening formed at the front surface thereof is formed at the rear portion of the speaker frame 13, and a magnetic circuit unit (driving mechanism) 16 serving to drive a speaker main body 11 is equipped at the rear side of the frame rear portion 15.

The magnetic circuit unit 16 has a yoke 16*c* having a disc-shaped yoke bottom portion 16*a*, and a cylindrical yoke protrusion portion 16*b* which protrudes forwards at the center portion of the yoke bottom portion 16*a*. An annular magnet 16*d* is fixed to the front surface of the yoke bottom portion 16*a* so as to surround the yoke protrusion portion 16*b*, and an annular plate 16*e* is fixed to the front side of the magnet 16*d*. A magnetic gap (not shown) is formed between the outer periphery of the yoke protrusion portion 16*b* and the inner periphery of the plate 16*e*, and a bobbin 21*a* and voice coils 22 formed by winding tinsel wires (lead wires) on the bobbin 21*a* are disposed in the magnetic gap.

An annular frame flat portion 17 which is coaxial with the center axis L1 of the voice coil speaker 1 and extends outwards from the edge of a circular opening formed at the front surface of the frame rear portion 15 along the periphery direction of the opening is formed in the speaker frame 13. The base end of a cylindrical frame barrel portion 18 which is configured to increase in diameter towards the front side and has a circular speaker opening 10 at the front surface thereof is connected to the outer periphery of the frame flat portion 17.

A damper 20 is connected to the edge of the circular opening formed at the front surface of the frame rear portion 15 so as to block the opening, and the cylindrical bobbin 21*a* extending in the same axial direction as the center axis L1 of the voice coil speaker 1 is supported at the center of the damper 20, whereby the bobbin 21*a* is supported by and fixed to the speaker frame 13. The damper 20 and the bobbin 21*a* are arranged coaxially with each other so that the center axes thereof are coincident with the center axis L1 of the voice coil speaker 1.

Figure 2:
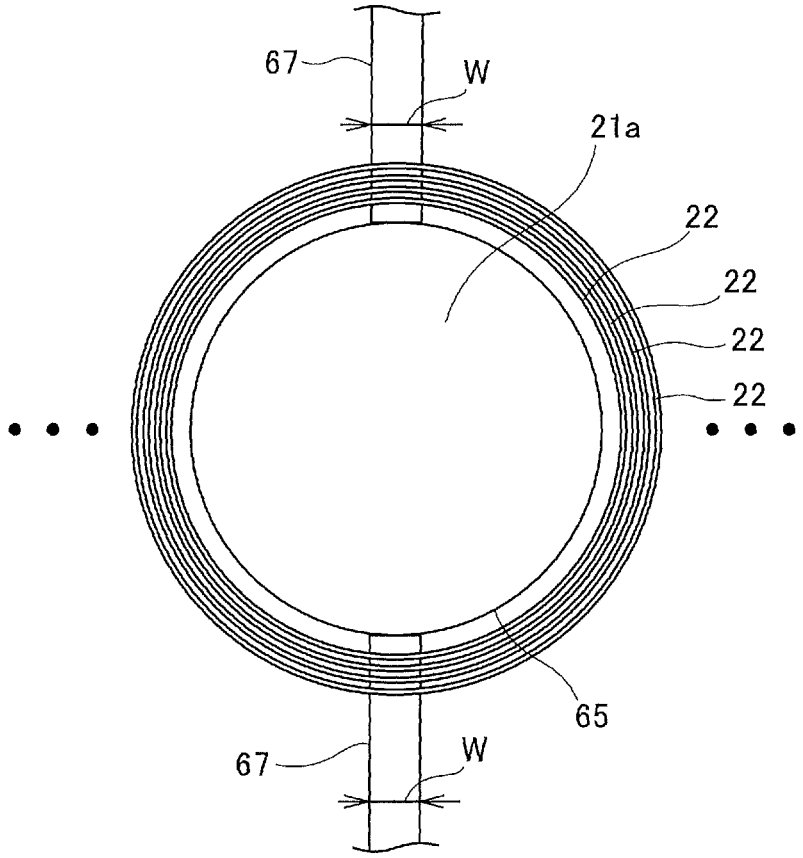
FIG. 2 is a top view of a bobbin on which a voice coil is formed.

FIG. 2 is a view of the bobbin 21*a* which is taken from the lower side thereof. In order to clarify the relationship between the bobbin 21*a* and the voice coils 22 in FIG. 2, they are schematically illustrated while the shapes thereof are simplified.

As shown in FIG. 2, the bobbin 21*a* holds plural voice coils 22 which are formed by regularly winding the lead wires formed of wire rods of copper wires or the like in the axial direction of the bobbin 21*a*. In this embodiment, the plural voice coils 22 are stacked and multilayered in the peripheral direction of the bobbin 21*a*. The respective voice coils 22 of the respective layers are electrically connected to an audio signal processing circuit board 32 described later, and configured to vibrate the bobbin 21*a* on the basis of driving signals input from the audio signal processing circuit board 32.

Referring to FIG. 1, the base end portion 25 of a conical diaphragm 24 which increases in diameter toward the front side is connected to the bobbin 21*a* coaxially with the center axis L1 of the voice coil speaker 1, and the outer periphery of the tip portion 26 of the diaphragm 24 is connected to the inner periphery of the speaker opening 10 formed at the front surface of the frame barrel portion 18 of the speaker frame 13. The diaphragm 24 vibrates in accordance with vibration of the bobbin 21*a* which is induced by the multilayered voice coils 22, and sounds are output on the basis of the vibration of the diaphragm 24.

An annular frame flange 27 is equipped to the outer periphery of the speaker opening 10 formed at the front surface of the frame barrel portion 18 so as to extend outwards from the edge of the outer periphery concerned along the peripheral direction of the opening, and plural screw holes (not shown) are formed in the frame flange 27. When the voice coil speaker 1 is fixed to the side surface of a door of a vehicle, the voice coil speakers 1 are screwed to the door through the screw holes (not shown).

Here, the audio signal processing circuit board 32 will be described in detail.

External equipment serving as an output source of audio signals such as an in-vehicle audio device or the like is connected to the audio signal processing circuit board 32, and the audio signal processing circuit board 32 is a digital circuit board on which a circuit for performing various kinds of digital processing on input digital audio signals to generate and output driving signals for the voice coils 22 of the respective layers is mounted.

More specifically, circuits such as a $\Delta\Sigma$ modulation circuit, various kinds of filter circuits, a digital amplifier, a digital driver circuit (D class driver), etc. are mounted on the audio signal processing circuit board 32. The audio signal processing circuit board 32 executes signal processing such as predetermined sampling processing, predetermined filtering processing, etc. on multi-channel audio signals input from external equipment which is connected to the audio signal processing circuit board 32 to generate a driving signal to be output to each voice coil 22, and outputs the generated driving signals to the respective voice coils 22. The bobbin 21*a* vibrates in accordance with the driving signal input from the audio signal processing circuit board 32 to each voice coil 22, and in connection with the vibration of the bobbin 21*a*, the diaphragm 24 is vibrated to output sounds.

Here, each of the circuits mounted on the audio signal processing circuit board 32 is a digital circuit, and thus it may be configured to be more remarkably compact as compared with a case where each circuit is an analog circuit. Particularly, the digital amplifier is more remarkably compact than an analog amplifier.

The audio signal processing circuit board 32 is fixed to the yoke 16*c* with screws 33 having electrical conductivity at the back side (rear side) of the yoke 16*c*, and covered by a conductive shield case 34 for reducing radiation noise. The shield case 34 is configured in a cylindrical shape having a bottom, and the opening portion thereof is secured to the outer peripheral surface of the yoke bottom portion 16*a*. A connection connector 35 connected to the audio signal processing circuit board 32 is buried in the shield case 34, and the external equipment described above is connected to the connection connector 35.

As described above, according to this embodiment, a driving signal to be output to each voice coil 22 is generated in the audio signal processing circuit board 32, and the generated driving signal is output to each of the voice coils 22. Therefore, it is necessary to equip plural signal lines for the driving signals in accordance with the number of the layers of the voice coils 22 (six layers in this embodiment). At this time, in order to suppress deterioration of sound quality, it is required to prevent the plural signal lines from interfering with one another, and it is also required to prevent motion of the bobbin 21*a* from being disturbed by the signal lines.

In consideration of the foregoing matters, according to this embodiment, the bobbin 21*a* and the other members such as the signal lines, etc. are configured as follows.

Figure 3:
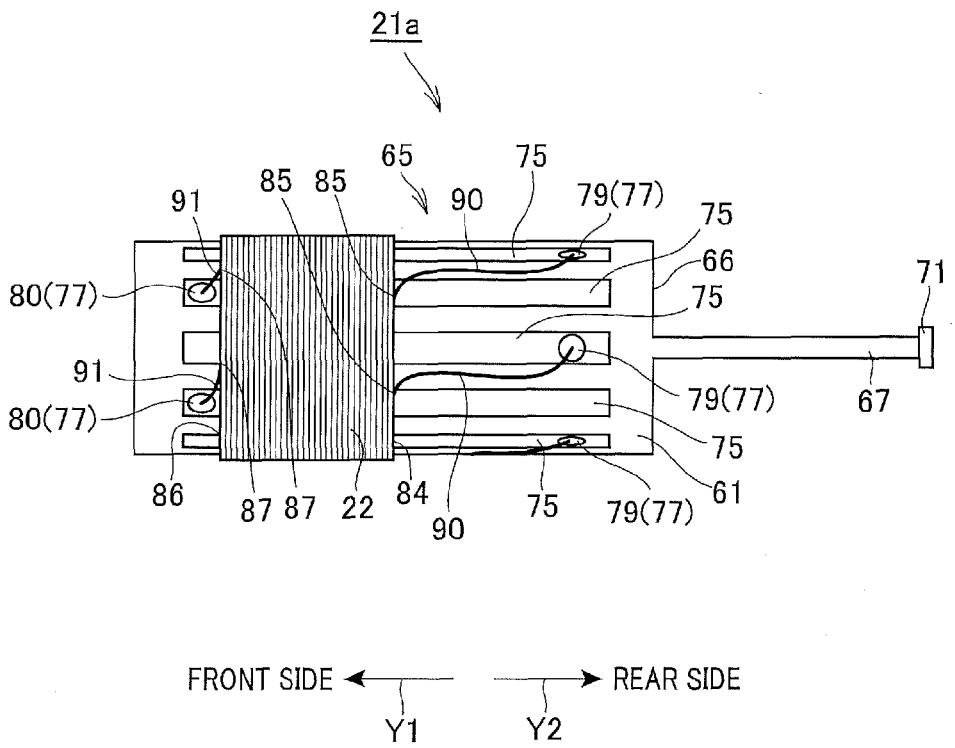
FIG. 3 is a side view of the bobbin.
Figure 4:
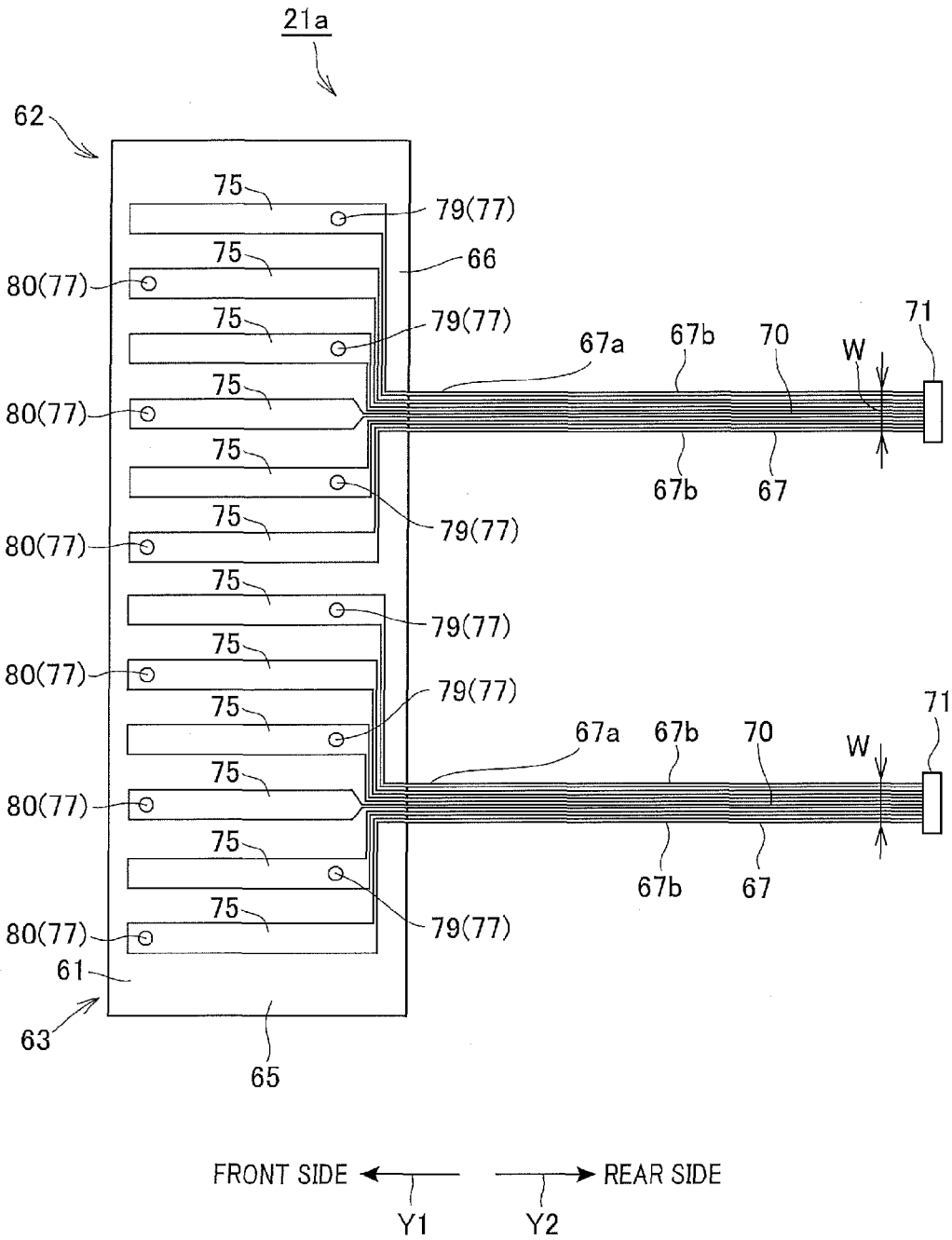
FIG. 4 is a diagram showing a bobbin before it is configured in a cylindrical shape.
Figure 5:
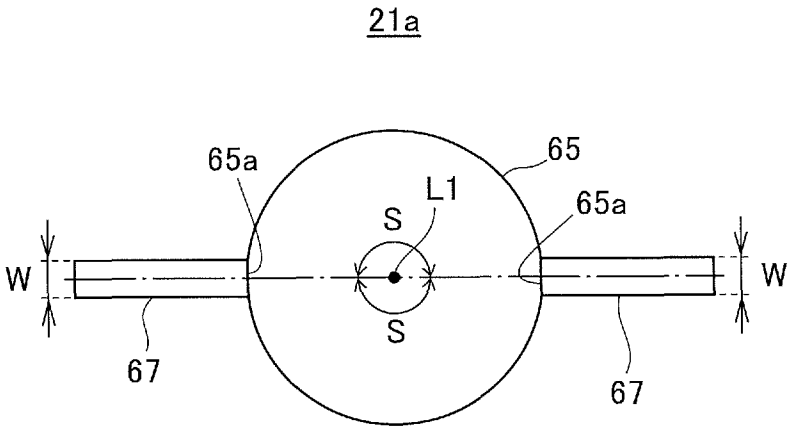
FIG. 5 is a front view showing the bobbin, wherein (A) shows the bobbin provided with one signal line portion, and (B) shows the bobbin provided with two signal line portions.
Figure 5:
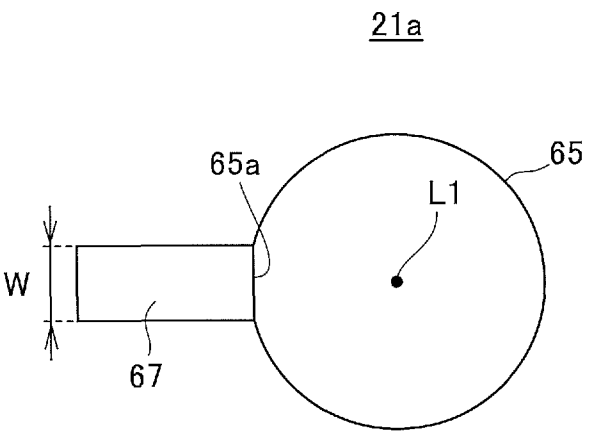

FIG. 3 is a side view of the bobbin 21*a* under the state that the voice coils 22 are wound around the bobbin 21*a*, and FIG. 4 is a diagram showing the bobbin 21*a* before it is configured in a cylindrical shape. The bobbin 21*a* shown in FIG. 4 is rolled so that a surface 61 corresponding to one surface of the bobbin 21*a* from which contact points 77 are exposed serves as a cylindrical outer surface, and then one end joint portion 62 and the other end joint portion 63 are joined to each other by a method such as adhesion or the like, thereby forming the cylindrical voice coil 22 shown in FIG. 3. FIG. 5 is a front view showing the bobbin 21*a*, wherein FIG. 5(A) shows the bobbin 21*a* equipped with one signal line portion 67, and FIG. 5(B) shows the bobbin 21*a* equipped with two signal line portions 67.

In FIGS. 3 and 4, it is assumed that the forward and rearward directions are defined as shown by arrows. That is, the direction represented by an arrow Y1 corresponds to the forward direction, and the direction represented by an arrow Y2 corresponds to the rearward direction.

As shown in FIG. 4, the bobbin 21*a* has a bobbin main portion 65 which is rectangular in front view, and two slender signal line portions (extension portions) 67 extend rearwards from a part of the rear end 66 extending in the longitudinal direction of the bobbin main portion 65 before it is configured in a cylindrical shape. The bobbin main portion 65 is rolled and the one end joint portion 62 and the other end joint portion 63 are joined to each other, whereby the bobbin main portion 65 becomes a cylindrical barrel portion. The two signal line portions 67 are located to be symmetrical with each other with respect to the center axis line L1 (FIG. 1) so as to face each other when the bobbin main portion 65 is configured in a cylindrical shape. In other words, the two signal line portions 67 are equipped at an equal interval S in the peripheral direction of the bobbin main portion 65.

In this embodiment, the bobbin main portion 65 and the signal line portion 67 are integrally formed of a flexible print board.

The signal line portions 67 of the bobbin 21*a* and the bobbin main portion 65 will be described in detail.

The signal line portion 67 constitutes the flexible print board, and plural signal line conductors 70 are pattern-formed as signal lines for driving signals to be output from the audio signal processing circuit board 32 to the voice coils 22.

The respective signal line conductors 70 are linear conductors, and arranged side by side along the signal line portion 67 to be spaced from one another at predetermined intervals in the signal line portions 67. The signal line conductor 70 is an electrically conductive member formed of thin film of metal such as copper or the like, and sandwiched by film having insulating properties such as polyimide film, photo-soldering resist film or the like, whereby insulation from the other signal line conductors 70 and the outside is secured and protection from physical contact is performed.

In this embodiment, the voice coils 22 of six layers are formed on the bobbin 21*a*, and totally twelve signal lines are required to be connected to the respective voice coils 22.

Six signal line conductors 70 are formed on each signal line portion 67 in conformity with a half of the twelve signal lines.

A signal line connector 71 is equipped to the tip of the signal line portion 67. The signal line connector 71 is a connector to be connected to the audio signal processing circuit board 32. These signal line connectors 71 are connected to the audio signal processing circuit board 32, and the electrical connection between the audio signal processing circuit board 32 and the signal line conductors 70 formed in the signal line portions 67 is implemented, whereby the driving signals from the audio signal processing circuit board 32 through the signal line conductors 70 to the voice coils 22 can be output.

When the signal line connectors 71 are connected to the audio signal processing circuit board 32 as shown in FIG. 1, the rear end 66 of the bobbin 65 and the audio signal processing circuit board 32 are set to be physically connected to each other through the signal line portions 67. Here, the bobbin 21*a* is a member which vibrates while accompanied by an output of sounds from the voice coil speaker 1, and thus the signal line portion 67 is equipped with a flexure portion (backlash portion) in consideration of the stroke amount of the bobbin 21*a*, whereby the smooth vibration of the bobbin 21*a* can be prevented from being disturbed by the signal line portions 67.

As described above, according to this embodiment, the bobbin 21*a* (bobbin main portion 65) and the audio signal processing circuit board 32 are connected to each other through the signal line portions 67 constructed by the flexible print board, and the audio signal processing circuit board 32 and the voice coils 22 are electrically connected through the signal line conductors 70 formed in the signal line portions 67.

The following effect is attained by the above configuration.

That is, the flexible print board has characteristics that it is thin and has excellent flexibility. Therefore, even when the audio signal processing circuit board 32 and the bobbin main portion 65 are set to be physically connected to each other through the signal line portions 67 (the state shown in FIG. 1), the signal line portions 67 can be suppressed from disturbing the vibration of the bobbin 21*a*, and thus deterioration of the sound quality can be prevented. Particularly, in this embodiment, it is necessary to connect the twelve signal lines from the audio signal processing circuit board 32 to the vice coils 22 of the bobbin 21*a*. If twelve tinsel wires are configured to extend from the audio signal processing circuit board 32 to the bobbin 21*a*, it would be required to perform strict design of the size, arrangement, etc. of the tinsel wires in consideration of the strength of the tinsel wires and implementation of smooth vibration of the bobbin 21*a*. However, according to this embodiments, the smooth vibration of the bobbin 21*a* can be easily and surely secured by using the signal line portions 67 as the flexible print boards.

It is further required that the respective signal lines connected to the voice coils 22 do not electrically interfere with one another to prevent deterioration of sound quality. In this embodiment, since the signal line portions 67 are the flexible print boards, the insulation state of each of the signal lines (signal line conductors 70 can be surely secured, and the electrical interference of the signal lines can be surely prevented. Particularly, the signal lines are connected to the voice coils 22 wound around the bobbin 21*a*, and thus the vibration of the bobbin 21*a* accompanied by output of sounds is necessarily transmitted to the signal lines. However, even when the bobbin 21*a* vibrates, such a situation that the respective signal lines interfere with one another does not occur. Furthermore, each of the signal lines (signal line conductors 70) is formed of an electrically conductive member which is formed on the flexible print board by printing, and thus such a situation that a signal line is cut off due to vibration of the bobbin 21*a* can be prevented from occurring as much as possible.

The signal line portion 67 is constructed by the flexible print board. Therefore, when each of the twelve signal lines (the signal line conductors 70 formed in the signal line portions 67) is electrically connected to the audio signal processing circuit board 32, the signal line connectors 71 of the signal line portions 67 may be connected to the audio signal processing circuit board 32. Therefore, the easiness of manufacturing of the voice coil speaker 1 is enhanced. This effect is more remarkable as compared with a case where each of the twelve signal lines is formed of a tinsel wire and the audio signal processing circuit board 32 and the voice coils 22 are connected through the tinsel wires.

Furthermore, from the viewpoint of the feature of this embodiment that the voice coils 22 of six layers are formed on the bobbin 21*a* and the signal lines are connected to the voice coils 22, current flowing in each signal line is reduced to one sixth as compared with a case where a voice coil 22 of one layer is formed. That is, the current flowing in each signal line is very small. Therefore, the width of the signal line conductors 7 can be narrowed at the signal line portion 67, which can reduce the width of the signal line portion 67 itself. Accordingly, the bendability and flexibility of the signal line portions 67 as the flexible print boards can be enhanced, and the deterioration of the sound quality can be more greatly prevented.

This embodiment is configured so that the two signal line portions 67 extend from the bobbin main portion 65, every six signal lines are equipped to each of the two signal line portions 67, totally twelve signal lines are equipped to the two signal line portions 67. Therefore, as compared with a case where one signal line portion 67 is equipped, the load imposed from the signal line portion 67 to the bobbin main portion 65 is dispersed, so that the bobbin main portion 65 can vibrate smoothly and the sound quality can be prevented from being deteriorated by the signal line portion 67.

Furthermore, the two signal line portions 67 are equipped to be located symmetrically with each other with respect to the center axis L1, that is, to be spaced at an equal interval S in the peripheral direction of the bobbin portion 65. Therefore, as compared with the case where only one signal line portion 67 is equipped, a load which is biased due to the signal line portion 67 is hardly applied to the bobbin main portion 65, and thus the balance of the loads applied from the signal line portions 67 to the bobbin main portion 65 are enhanced, so that the bobbin main portion 65 vibrates smoothly and the sound quality can be prevented from being deteriorated by the signal line portion 67. Particularly, in this embodiment, the signal line portions 67 are supported by only the base portions 67*a* and the signal line connectors 71 at the tips thereof, the whole deadweight of the signal line portions 67 are applied to the bobbin main portion 65. Accordingly, the loads from the signal line portions 67 are substantially equally applied to the bobbin main portion 65 by arranging the two signal line portions 67 at an equal interval S in the peripheral direction of the bobbin main portion 65, so that the effect of preventing the sound quality from being deteriorated by the signal line portions 67 is remarkable.

When the plural signal line conductors 70 are provided to the signal line portion 67, the bobbin main portion 65 at a portion to which the signal line portion 67 extends is relatively lower in bendability and flexibility. Therefore, in a case where only one signal line portion 67 is provided as shown in FIG. 5(A), the site 65*a* of the bobbin main portion 65 at which the signal line portion 67 extends trends to become linear without being rounded along the circular shape when the bobbin main portion 65 is rolled and configured in a cylindrical shape.

On the other hand, since two signal line portions 67 are provided as shown in FIG. 5(B) in this embodiment, the width W of each signal line portion 67 is narrower as compared with the case where only one signal line portion 67 is equipped, and thus the bendability and flexibility of the signal line portions 67 can be greatly enhanced. In addition, the linear site 65*a* of the bobbin main portion 65 is small, and thus the rolled bobbin main portion 65 can be approached to a true circle. Therefore, the vibration of the bobbin 21*a* can be substantially equally transmitted in the peripheral direction to the diaphragm 24, and the deterioration of the sound quality can be prevented.

Next, the bobbin main portion 65 will be described in detail.

The bobbin main portion 65 is constructed by a flexible print board, and twelve bobbin conductors 75 which extend in the front-and-rear direction as shown in FIG. 4 and are formed of thin film of metal such as copper or the like are pattern-formed and arranged side by side at substantially equal intervals. Each of the bobbin conductors 75 is pinched by film having insulating property such as polyimide film, photo-soldering resist film or the like, so that it is kept to be insulated from the other bobbin conductors 75 and the outside, and also protected from physical contact. Particularly, in this embodiment, the flexible print board constituting the bobbin main portion 65 is FPC having a three-layer structure coated with seal members on both the surfaces thereof, whereby radiation noise caused by digital signals can be reduced.

As described above, in this embodiment, the signal line portions 67 and the bobbin main portion 67 are integrally configured by one flexible print board. Therefore, as compared with a case where the signal line portion 67 and the bobbin main portion 65 are formed of individual members, a step for connecting the signal line portion 67 and the bobbin main portion 65, etc. are unnecessary, and the easiness of the manufacturing of the voice coil speaker 1 can be enhanced. Particularly, the respective signal line conductors 70 formed in the signal line portions 67 and the bobbin conductors 75 formed on the bobbin main portion 65 are integrally pattern-formed by the same conductor members. Therefore, the easiness of the manufacturing can be enhanced while the conduction state of the conductors can be surely maintained.

Contact points 77 which are formed in association with the bobbin conductors 75 by exposing the bobbin conductors 75 from the surface 61 are equipped to the surface 61 of the bobbin main portion 65. In this embodiment, the twelve bobbin conductors 75 are formed on the bobbin main portion 75, and each contact point 77 is formed on each bobbin conductor 75, that is, totally twelve contact points 77 are formed on the bobbin conductors 75.

There are two types of contact points 77, one type of contact points 77 being formed at the front portions of the bobbin conductors 75 (hereinafter referred to as "winding-start connection contact points 79") and the other type of contact points 77 being formed at the rear portions of the bobbin conductors 75 (hereinafter referred to as "winding-end connection contact points 80"), and these types of contact points 77 are alternately arranged in accordance with the arrangement of the bobbin conductors 75.

The relationship of a certain voice coil 22 out of the voice coils 22 of six layers, and the winding-start and winding-end connection contact points 80 corresponding to the voice coil 22 concerned, and the detailed constructions of these members will be described hereunder.

As shown in FIG. 3, the voice coil 22 is configured by winding a lead wire around the bobbin main portion 65. In this embodiment, the whole body of the voice coil 22 is formed by singularly winding the lead wire from a winding start portion 85 of a front end edge 84 (a site at which the winding of the lead wire starts) to a winding end portion 87 of a rear end edge 86 formed at the rear side of the front end edge 84 (a site at which the winding of the lead wire finishes). A pre-wind lead wire 90 as a lead wire before winding extends from the winding start portion 85, and a post-wind lead wire 91 as a lead wire after winding extends from the winding end portion 87.

The voice coil 22 is formed between the winding-start connection contact points 79 and the winding-end connection contact points 80 on the bobbin main portion 65. The pre-winding lead wire 90 extending from the winding-start portion 85 of the voice coil 22 is connected (conducted) to the corresponding one winding-start connection contact point 79 by means such as soldering or the like, and also the post-winding lead wire 91 extending from the winding end portion 87 is connected (conducted) to the corresponding one winding-end connection contact point 80. Accordingly, the electrical connection leaking from the audio signal processing circuit board 32→the signal line conductor 70→the bobbin conductor 75→the winding-start connection contact point 79→the pre-winding lead wire 90→the voice coil 22→the post-winding lead wire 91→the winding-end connection contact point 80→the bobbin conductor 75→the signal line conductor 70 to the audio signal processing circuit board 32 is established, whereby a configuration of enabling a driving signal to be output from the audio signal processing circuit board 32 to the voice coil 22 can be established.

As described above, in the voice coil speaker 1 for outputting the driving signal to the voice coil 22 through the signal line, it is necessary to suppress the adverse effect of the existence of the signal line on the operation of the voice coil 22 and thus prevent deterioration of the sound quality.

Furthermore, radiation noise caused by digital signals occurs in the signal line portion 67, and thus it is necessary to take a countermeasure to reduce the radiation noise. For example, when the signal line portion 67 is covered with a shield member, the thickness (size) of the signal line is increased due to the shield member, and thus the motion of the bobbin 21*a* is greatly disturbed. As a result, the sound quality of sounds output from the voice coil speaker 1 may be deteriorated. Therefore, according to this embodiment, at least a part of the signal line portion 67 is covered by a shield case 34.

The shield construction for the signal line portion 67 will be described in detail with reference to FIGS. 6 to 8.

Figure 6:
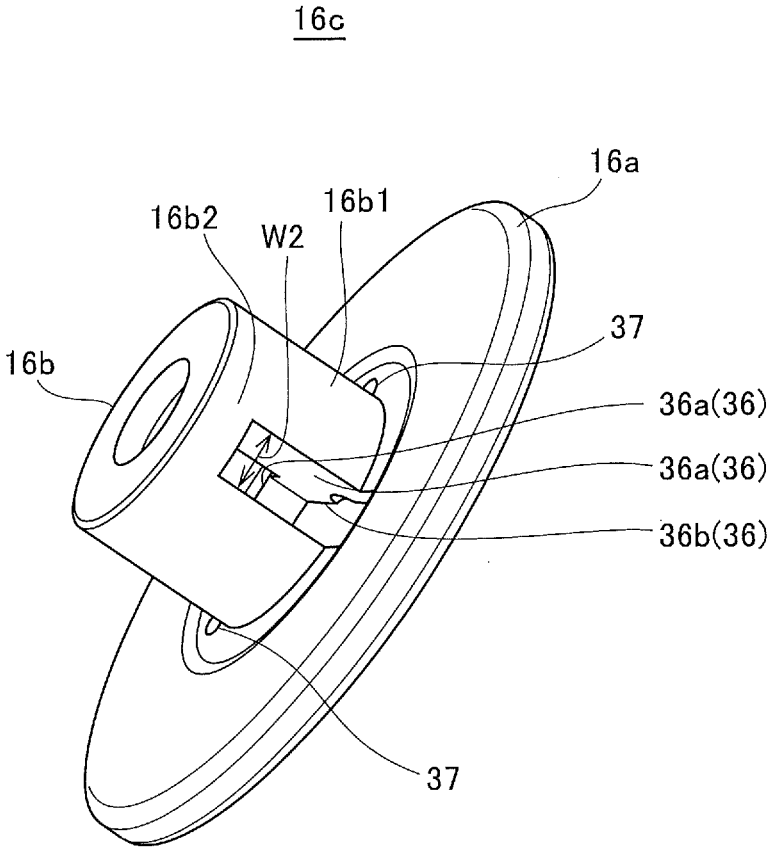
FIG. 6 is a perspective view of a yoke which is taken from the front side.
Figure 7:
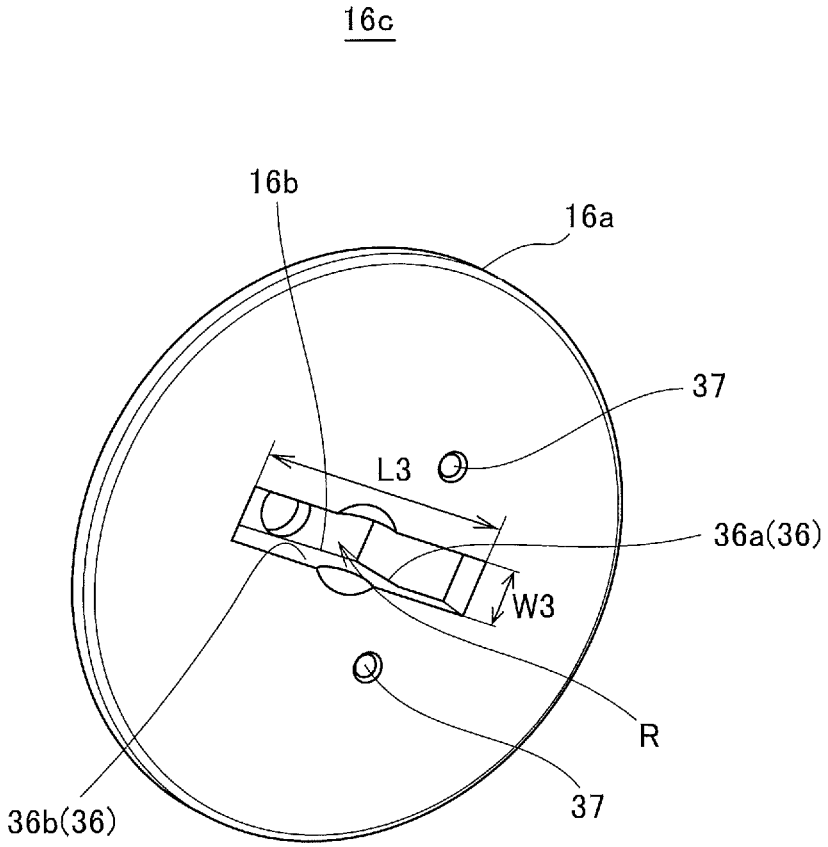
FIG. 7 is a perspective view of the yoke which is taken from the back side.
Figure 8:
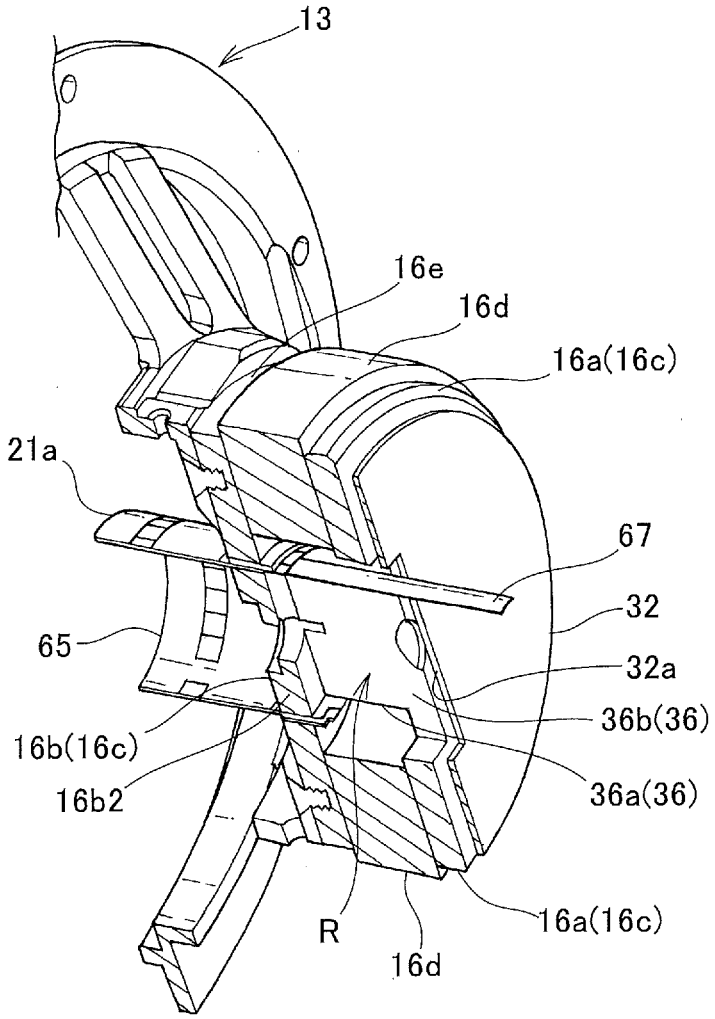
FIG. 8 is a cross-sectional view showing a voice coil speaker.

FIG. 6 is a perspective view of the yoke 16*c* which is taken from the front side, and FIG. 7 is a perspective view of the yoke 16*c* which is taken from the back side. FIG. 8 is a cross-sectional view showing the voice coil speaker 1.

Cut-out portions 36 through which the signal line portions 67 are passed to the back side of the yoke 16*c* are formed in the yoke 16*c*. More specifically, the yoke 16*c* comprises the disc-shaped yoke bottom portion 16*a* and the cylindrical yoke protrusion portion 16*b* protruding forwards at the center portion of the yoke bottom portion 16*a* as described above. Side-surface cut-out portions 36*a* are formed in the yoke protrusion portion 16*b*, and a bottom-surface cut-out portion 36*b* intercommunicating with the side-surface cut-out portions 36*a* is formed in the yoke bottom portion 16*a*.

The side surface cut-out portions 36*a* on the side surface 16*b*1 of the yoke protrusion portion 16*b* correspond to those sites which avoid a voice coil confronting portion 16*b*2 facing the voice coils 22 (FIG. 1), and equipped at the places corresponding to the respective signal line portions 67. In this embodiment, the two signal line portions 67 are equipped to be located symmetrically with each other with respect to the center axis L1 (FIG. 1). Therefore, the side surface cut-out portions 36*a* equipped at the sites corresponding to the respective signal line portions 67 confront each other.

Each side surface cut-out portion 36*a* has such a size that at least the signal line portion 67 can be passed therethrough. Specifically, each side surface cut-out portion 36*a* has a rectangular shape extending along the center axis L1 of the voice coil speaker 1, and the width W2 of the side surface cut-out portion 36*a* is set to be larger than at least the width W of the signal line portion 67.

The bottom surface cut-out portion 36*b* is formed substantially at the center of the yoke bottom portion 16*a*. In this embodiment, one bottom surface cut-out portion 36*b* intercommunicates with the two side surface cut-out portion 36*a*, and is formed in a substantially rectangular shape in back view. The width W3 of the bottom surface cut-out portion 36*b* is set to be larger than at least the width W of the signal line portion 67, and the length L3 of the bottom surface cut-out portion 36*b* is set to such a length that the two signal line portions 67 are allowed to move when the bobbin main portion 65 vibrates.

In this embodiment, the confronting two side surface cut-out portions 36*a* intercommunicate with each other, and a cavity portion R with which the two side surface cut-out portions 36*a* and the bottom surface cut-out portion 36*b* intercommunicate is formed inside the yoke 16*c*.

Screw holes 37 with which screws 33 (FIG. 1) for fixing the audio signal processing circuit board 32 are threadably fitted are formed in the yoke bottom portion 16*a*.

The audio signal processing circuit board 32 has a board cut-out portion 32*a* which is provided at the position corresponding to the bottom cut-out portion 36*b* to pass the signal line portions 67 to the back side of the yoke 16*c*. The width of the board cut-out portion 32*a* is also set to be larger than the width W of the signal line portion 67 as in the case of the side surface cut-out portion 36*a*, and the length of the board cut-out portion 32*a* is set to such a length that the two signal line portions 67 are allowed to move when the bobbin main portion 65 vibrates.

The signal line portions 67 extending from the bobbin main portion 65 pass through the cut-out portion 36 of the yoke 16*c*, and extend into a shield case 34 at the back side of the yoke 16*c*. Accordingly, the signal line portions 67 are covered by the yoke 16*c* which is formed of a conductive member and thus has a shield effect, and the conductive shield case 34 for reducing radiation noise, so that the substantially whole area of the signal line portions 67 can be shielded. Accordingly, radiation noise caused by digital signals flowing through the signal line portions 67 can be shielded, and also noises from the external can be surely prevented from adversely affecting signals flowing in the signal lines formed in the signal line portions 67, so that the sound quality can be enhanced.

The cut-out portion 36 is covered by the shield case 34, and thus dust can be prevented from intruding from the cut-out portion 36 into the voice coil speaker 1.

In addition, since the cut-out portion 36 comprises the side surface cut-out portions 36*a* formed at the sites corresponding to the signal line portions 67 on the side surface 16*b*1 of the yoke protrusion portion 16*b*, and the bottom cut-out portion 36*b* intercommunicating with the side surface cut-out portions 36*a* formed in the yoke bottom portion 16*a*, the cut-out portion 36 formed in the side surface 16*b*1 of the yoke protrusion portion 16*b* can be minimized in size. Accordingly, provision of the cut-out portion 36 in the yoke 16*c* can be suppressed from affecting the magnetic field, and the signal line portions 67 can be made to extend to the back side of the yoke 16*c* without obstructing the vibration of the bobbin 21*a*.

Furthermore, since the signal line portions 67 are covered by the yoke 16*c* and the shield case 34, it is unnecessary to attach a shield member to the signal line portion 67, and thus the signal line portion 67 can be formed to be remarkably thin. Accordingly, degradation of the bendability of the signal line portion 67 can be suppressed, and the signal line portion 67 can be prevented from obstructing vibration of the bobbin main portion 65, so that deterioration of the sound quality can be prevented. As described above, the bobbin main portion 65 is covered with a shield member at both the sides thereof, so that radiation noise caused by digital signals can be reduced.

The audio signal processing circuit board 32 is disposed at the back side of the yoke 16*c*, and thus the signal line portions 67 and the audio signal processing circuit board 32 can be shielded by one shield case 34. Therefore, the number of parts can be reduced and the manufacturing process can be simplified while radiation noise occurring in the signal line portions 67 and the audio signal processing circuit board 32 is reduced.

The audio signal processing circuit board 32 is fixed to the yoke 16*c* by the screws 33 having electrical conductivity. Therefore, heat of the audio signal processing circuit board 32 is radiated through the yoke 16*c* to the outside, so that the heat can be sufficiently radiated even when the audio signal processing circuit board 32 is hermetically sealed by the shield case 34.

The cavity portion R in the yoke 16*c* is formed at such a size that the flexure portion (backlash portion) of the signal line portion 67 based on the stroke amount of the bobbin main portion 65 can be accommodated therein. Therefore, the signal line portions 67 do not interfere with other members when the bobbin main portion 65 vibrates, and the motion of the bobbin main portion 65 is not disturbed, so that the deterioration of the sound quality can be prevented.

In this embodiment, the signal line portion 67 passed through the cut-out portion 36 of the yoke 16*c* is passed through a board cut-out portion 32*a* of the audio signal processing circuit board 32, and drawn to the back side of the audio signal processing circuit board 32, and the signal line connector 71 of the signal line portion 67 is connected to the back surface of the audio signal processing circuit board 32. Accordingly, after the audio signal processing circuit board 32 is fixed to the yoke 16*c*, the signal line connector 71 can be connected to the audio signal processing circuit board 32, so that the signal line connector 71 can be easily connected. FIG. 8 shows the signal line portion 67 before it is connected to the audio signal processing circuit board 32.

The signal line portion 67 connected to the audio signal processing circuit board 32 moves with the signal line connector 71 serving as an action fulcrum when the bobbin main portion 65 is vibrated on the basis of a driving signal. As described above, the signal line connector 71 serving as the action fulcrum is disposed at the audio signal processing circuit board 32 fixed to the yoke 16*c*, so that the operation of the signal line portion 67 caused by the vibration of the bobbin main portion 65 can be stabilized, and the signal line portion 67 can be suppressed from obstructing the vibration of the bobbin main portion 65. Therefore, the deterioration of the sound quality can be prevented.

As described above, the voice coil speaker 1 according to this embodiment has the diaphragm. 24 and the bobbin 21*a* which is connected to the diaphragm 24 and has the voice coils 22 formed thereon, and is configured so that the bobbin 21*a* has the bobbin main portion 65 having the voice coils 22 wound therearound, and the signal line portions 67 which are extend from the bobbin main portion 65 and in which the signal lines conducted to the voice coils 22 are formed, the bobbin main portion 65 and the signal line portions 67 are integrally formed of the flexible print board, and the site at which the signal line portions 67 is covered by the shield case 34 (the back side of the yoke 16*c* in this embodiment). By this configuration, at least a part of the signal line portion 67 is covered by the shield case 34. Therefore, noise to signals flowing in the signal lines formed in the signal line portions 67 can be prevented, so that the sound quality can be enhanced.

Furthermore, since it is unnecessary to cover the signal line portion 67 with the shield member, the degradation of the bendability of the signal line portions 67 can be suppressed, and the signal line portions 67 can be suppressed from obstructing the vibration of the bobbin main portion 65, so that the degradation of the sound quality can be prevented.

Furthermore, the signal line portions 67 are formed of the thin flexible print board having excellent bendability. Therefore, the signal line portions 67 can be suppressed from obstructing the vibration of the bobbin main portion 65, and the degradation of the sound quality can be prevented.

In this embodiment, the shield case 34 is equipped at the back side of the yoke 16*c*, the cut-out portion 36 is formed in the yoke 16*c*, the signal line portions 67 are passed through the cut-out portion 36 so as to extend into the shield case 34 at the back side of the yoke 16*c*. According to this construction, the substantially whole area of the signal line portions 67 can be shielded by the yoke 16*c* which is formed of a conductive member and has the shield effect, and the shield case 34 so that the noise to the signal line portions 67 can be surely suppressed.

Furthermore, in this embodiment, the yoke 16*c* has the yoke bottom portion 16*a* and the yoke protrusion portion 16*b* projecting from the yoke bottom portion 16*a* into the bobbin 21*a*. The side surface cut-out portions 36*a* are formed at the sites corresponding to the signal line portions 67 on the side surface 16*b*1 of the yoke protrusion portion 16*b*, the bottom cut-out portion 36*b* intercommunicating with the side surface cut-out portions 36*a* is formed in the yoke bottom portion 16*a*, and the signal line portions 67 extending from the bobbin main portion 65 extend through the side surface cut-out portions 36*a* and the bottom cut-out portion 36*b* into the shield case 34 at the back side of the yoke 16*c*. According to this construction, the size of the cut-out portion 36 equipped to the yoke 16*c* can be minimized, so that the signal line portions 67 can be made to extend to the back side of the yoke 16*c* while the provision of the cut-out portion 36 to the yoke 16*c* can be suppressed from affecting the magnetic field.

Still furthermore, in this embodiment, the audio signal processing circuit board 32 for processing audio signals is disposed in the shield case 34 equipped at the back side of the yoke 16*c*, and the signal line connectors 71 at the tips of the signal line portions 67 are connected to the audio signal processing circuit board 32. The audio signal processing circuit board 32 is an indispensable constituent element for the voice coil speaker 1. According to the above construction, the signal line portions 67 and the audio signal processing circuit board 32 can be shielded by one shield case 34, so that the number of parts can be reduced and the manufacturing process can be simplified.

Second Embodiment

Next, a second embodiment will be described with reference to FIG. 9.

Figure 9:
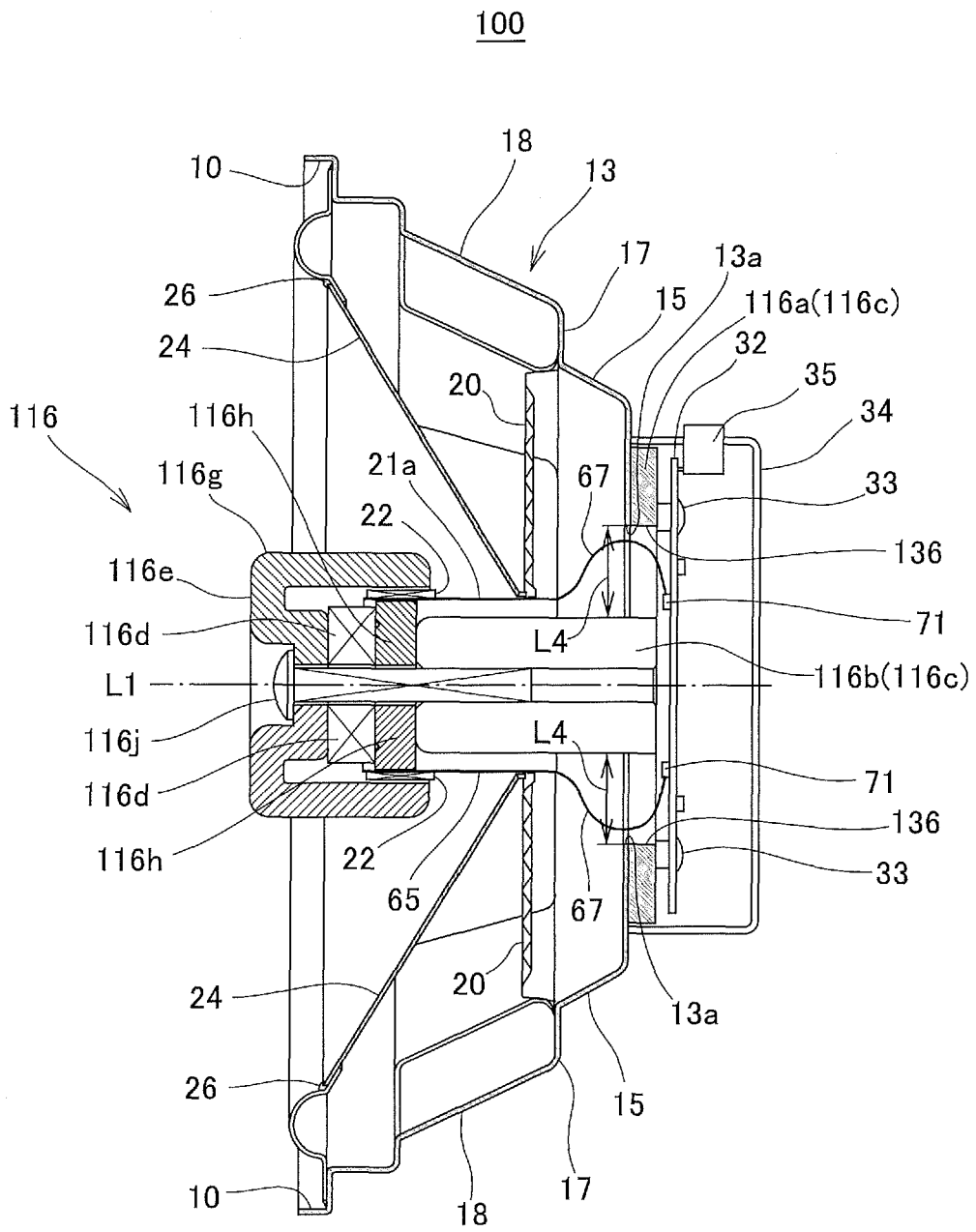
FIG. 9 is a cross-sectional view showing a voice coil speaker according to a second embodiment of the present invention.

FIG. 9 is a cross-sectional view showing a voice coil speaker 100 according to the second embodiment.

In the following description, the same constituent elements as the first embodiment described above are represented by the same reference numerals, and the description thereof is omitted.

In the first embodiment, the magnetic circuit unit 16 is equipped at the backside of the diaphragm 24. However, in the second embodiment, a driving unit 116*g* of a magnetic circuit unit 116 is equipped at the front side of the diaphragm 24. In this embodiment, the frame flange 27 is omitted.

The magnetic circuit unit 116 has a yoke 116*c* which has a disc-shaped yoke bottom portion 116*a*, a cylindrical yoke protrusion portion 116*b* which projects to the front side of the diaphragm 24 at the center portion of the yoke bottom portion 16*a*, and a yoke main body 116*h* disposed at the front end of the yoke protrusion portion 116*b*. An annular magnet 116*d* is fixed to the front surface of the yoke main body 116*h*, and the yoke main body 116*h* and the magnet 116*d* are surrounded by a cylindrical barrel body 116*e* with a bottom which has a bottom portion at the front surface of the yoke main body 116*h*. The yoke main body 116*h*, the magnet 116*d* and the barrel body 116*e* constitute the driving portion 116*g* of the magnetic circuit unit 116, and the driving portion 116*g* is positioned while the center axis thereof is coincident with the center axis L1 of the voice coil speaker 100, and then fixed to the yoke protrusion portion 116*b* at the front side of the diaphragm 24 by a bolt 116*j*. As described above, according to this embodiment, the driving portion 116*g* of the magnetic circuit unit 16 is disposed at the front side of the diaphragm 24, thereby effectively using a space formed at the front side of the diaphragm 24.

A bobbin 21*a* and voice coils 22 formed by winding tinsel wires (lead wires) on the bobbin 21*a* are disposed between the outer periphery of the yoke main body 116*h* and the inner periphery of the barrel body 116*e*. The bobbin 21*a* is supported by a damper 20 at the rear end 66 side of the bobbin main portion 65, and the diaphragm 24 is supported by the bobbin main portion 65 at a position near to the center position in the axial direction than the rear end 66 of the bobbin main portion 65.

Cut-out portions 136 through which the signal line portions 67 are passed to the back side of the yoke 116*c* are formed in the yoke bottom portion 116*a*. The cut-out portions 136 are provided at positions which are at the outside of the yoke protrusion portion 116*b* and correspond to the signal line portions 67, and each cut-out portion 136 has such a size that at least the signal line portion 67 can be passed therethrough. Each cut-out portion 136 of this embodiment has a rectangular shape extending in the radial direction of the yoke bottom portion 116*a*, the width of the cut-out portion 136 is set to be larger than at least the width W of the signal line portion 67, and the length L4 of the cut-out portion 136 is set to such a length that the signal line portion 67 is allowed to move when the bobbin main portion 65 vibrates.

A frame cut-out portion 13*a* which has substantially the same size as the cut-out portion 136 is formed at the position corresponding to the cut-out portion 136 in the speaker frame 13.

The signal line portion 67 extending from the bobbin main portion 65 is made to pass through the frame cut-out portion 13*a* of the speaker frame 13 and the cut-out portion 136 of the yoke 116*c* and extend into the shield case 34 at the back side of the yoke 16*c*. Accordingly, the signal line portions 67 are covered by the yoke 116*c* which is formed of a conductive member and has a shield effect, and the conductive shield case 34 which reduces radiation noise, so that most of the signal line portions 67 can be shielded. Therefore, substantially the same effect as the first embodiment can be obtained. In this embodiment, it is desired to cover a shield member on the portion of the signal line portion 67 which is not covered by the yoke 116*c* or the shield case 34.

The signal line connector 71 of the signal line portion 67 passed through the cut-out portion 136 of the yoke 116*c* is connected to the surface (at the yoke 116*c* side) of the audio signal processing circuit board 32. After the signal line connector 71 is connected, the audio signal processing circuit board 32 is fixed to the yoke 116*c*.

The embodiments described above are examples of the present invention, and any modification and application may be made within the scope of the present invention.

For example, in the above embodiments, the voice coils 22 of six layers are formed on the bobbin 21*a*. However, the number of the layers of the voice coils 22 is not limited to this number. That is, the present invention is broadly applicable to a voice coil speaker 1 in which voice coils 22 of one or plural layers are formed on the bobbin 21*a*.

Figure 10:
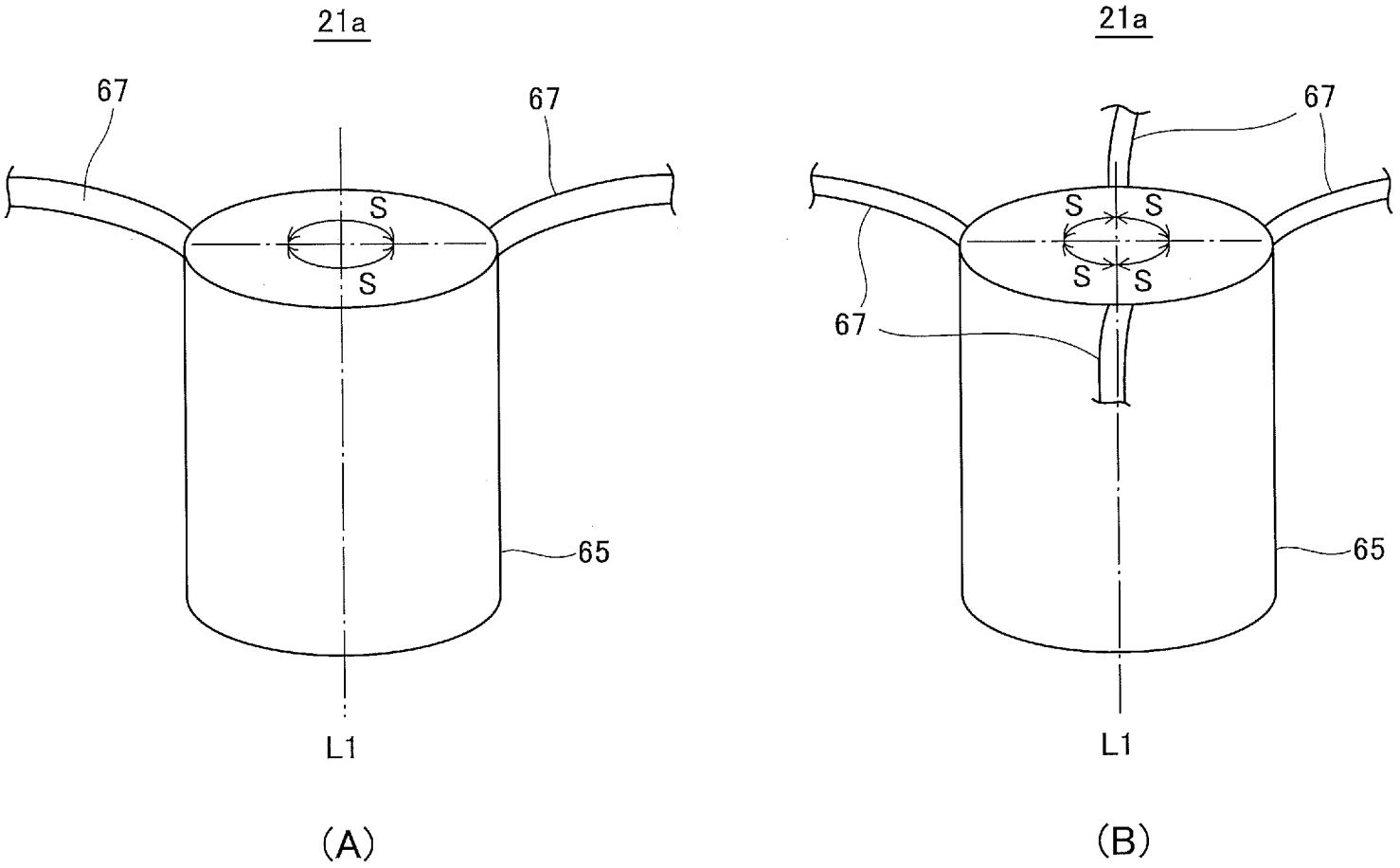
FIG. 10 is a perspective view showing a bobbin, whereby (A) shows the bobbin provided with two signal lines, and (B) shows the bobbin provided with four signal line portions.

Furthermore, in the above embodiments, two signal line portions 67 are equipped. However, one signal line portion 67 or a plurality of, three or more signal line portions 67 may be equipped. When plural signal line portions 67 are equipped, it is desired that the plural signal line portions 67 are arranged at symmetrical positions with respect to the center axis L1 of the bobbin 21*a* as shown in FIG. 10, in other words, arranged at equal intervals S in the peripheral direction of the cylindrical bobbin main portion 65. Accordingly, force from the signal line portions 67 is substantially equally applied to the bobbin main portion 65, and a biased load is hardly applied to the bobbin main portion 65. Therefore, the bobbin main portion 65 vibrates smoothly, and the deterioration of the sound quality which is caused by the signal line portions 67 can be prevented. When the number of the signal line portions 67 is odd, it is impossible to place the signal line portions 67 symmetrically with each other with respect to the center axis L1 of the bobbin 21*a*. Therefore, the signal line portions 67 may be arranged at equal intervals S in the peripheral direction of the bobbin main portion 65.

As the number of the signal line portions 67 increases, the width of each signal line portion 67 can be reduced. Therefore, the bendability and flexibility of the signal line portions 67 can be secured more greatly. In addition, the linear site 65*a* of the bobbin main portion 65 becomes smaller, and the rolled bobbin main portion 65 can be made closer to a true circle. Accordingly, the vibration of the bobbin 21*a* can be transmitted to the diaphragm 24 (FIG. 1, etc.) substantially equally in the peripheral direction, so that the deterioration of the sound quality can be prevented.

Furthermore, in the above embodiments, one bottom surface cut-out portion 36*a* is equipped to the two side cut-out portion 36*b*. However, the present invention is not limited to this style, and the bottom surface cut-out portion 36*b* may be formed for each of the side surface cut-out portions 36*a*.

Still furthermore, in the above embodiments, the audio signal processing circuit board 32 is disposed in the shield case 34 at the back side of the yoke 16*c*, 116*c*. However, the board disposed in the shield case 34 is not limited to this style. For example, when the audio signal processing circuit board 32 is configured to be separate from the voice coil speaker 1, 100, a board for connecting the signal line portions 67 and the external audio signal processing circuit board 32 may be disposed in the shield case 34.

Furthermore, in the above embodiments, the substantially whole area of the signal line portion 67 is covered by the yoke 16*c* and the shield case 34, but the present invention is not limited to this construction. For example, the substantially whole area of the signal line portion 67 may be covered by the shield case 34, or a part of the signal line portion 67 may be covered by the yoke 16*c* and/or the shield case 34.

In the above embodiments, the voice coil speaker 1, 100 is equipped to a vehicle. However, the voice coil speaker 1, 100 is not limited to an in-vehicle mount type.

DESCRIPTION OF REFERENCE NUMERALS

1, 100 voice coil speaker
16*c* yoke
16*a* yoke bottom portion
16*b* yoke protrusion portion
21*a* bobbin
22 voice coil
24 diaphragm
32 audio signal processing circuit board (circuit board)
34 shield case
36 cut-out portion
36*a* side surface cut-out portion
36*b* bottom surface cut-out portion
65 bobbin main portion
67 signal line portion (extension portion)
L1 center axis
S equal interval

The invention claimed is:

1. A voice coil speaker comprising:

a diaphragm; and a bobbin that is connected to the diaphragm and has a voice coil formed thereon, wherein the bobbin has a bobbin main portion around which the voice coil is wound, and an extension portion that extends from the bobbin main portion and in which a signal line conducted to the voice coil is formed, the bobbin main portion and the extension portion are integrally formed of a flexible print board, and a site at which the extension portion extends is covered by a shield case, wherein the shield case is equipped at a back side of a yoke, a cut-out portion is formed in the yoke, and the extension portion is configured to pass through the cut-out portion and extend into the shield case at the back side of the yoke, and wherein the yoke has a yoke bottom portion and a yoke protrusion portion protruding from the yoke bottom portion into the bobbin, a side surface cut-out portion is formed at a site corresponding to the extension portion on a side surface of the yoke protrusion portion, a bottom surface cut-out portion intercommunicating with the side surface cut-out portion is formed in the yoke bottom portion, and the extension portion extending from the bobbin main portion is configured to pass through the side surface cut-out portion and the bottom surface cut-out portion and extend into the shield case at the back side of the yoke.

2. The voice coil speaker according to claim 1, wherein the side surface cut-out portion is formed at a site on the side surface of the yoke protrusion portion where the side surface cut-out portion avoids to face the voice coil.

3. The voice coil speaker according to claim 1, wherein a circuit board for processing audio signals is disposed in the shield case equipped at the back side of the yoke, and a tip of the extension portion is connected to the circuit board.

4. The voice coil speaker according to claim 3, wherein a digital driver circuit is mounted on the circuit board.

5. The voice coil speaker according to claim 1, wherein a plurality of extension portions are equipped, and the plurality of extension portions are located to be symmetrical with one another with respect to a center axis of the bobbin.

6. The voice coil speaker according to claim 1, wherein the plurality of extension portions are equipped at equal intervals in a peripheral direction of the bobbin.

* * * * *